United States Patent [19]

Deguchi

[11] 4,140,553

[45] * Feb. 20, 1979

[54] METHOD FOR TOUGHENING TREATMENT OF METALLIC MATERIAL

[75] Inventor: Akio Deguchi, Yokohama, Japan

[73] Assignee: Mitsubishi Jukogyo Kabushiki Kaisha, Tokyo, Japan

[ * ] Notice: The portion of the term of this patent subsequent to Aug. 30, 1994, has been disclaimed.

[21] Appl. No.: 776,293

[22] Filed: Mar. 10, 1977

Related U.S. Application Data

[63] Continuation-in-part of Ser. No. 537,393, Dec. 30, 1974, Pat. No. 4,045,254.

[51] Int. Cl.[2] ..... C22F 1/04

[52] U.S. Cl. ..... 148/11.5 A; 148/12.7 A; 148/137

[58] Field of Search ..... 148/4, 12 R, 12.4, 131, 148/12 C, 12 E, 12 EA, 11.5 A, 127 A

[56] References Cited

U.S. PATENT DOCUMENTS

| | | | |
|---|---|---|---|
| 1,946,545 | 2/1934 | Pessel | 148/131 |
| 3,337,376 | 8/1967 | Grange | 148/36 X |
| 3,438,822 | 4/1969 | Allen | 148/36 X |
| 3,459,599 | 8/1969 | Grange | 148/12 |
| 3,748,197 | 7/1973 | Willson et al. | 148/131 |
| 3,857,741 | 12/1974 | Hultgren et al. | 148/37 |
| 3,951,697 | 4/1976 | Sherby et al. | 148/12 R |
| 3,986,898 | 10/1976 | Oshida | 148/13.2 |
| 3,998,665 | 12/1976 | Oshida | 148/12 R |
| 4,045,254 | 8/1977 | Deguchi | 148/12 R |

FOREIGN PATENT DOCUMENTS

| | | |
|---|---|---|
| 2118708 | 7/1972 | France. |
| 1330388 | 9/1973 | United Kingdom. |

OTHER PUBLICATIONS

Kaibyshev et al., Metallovedenie i Termicheskaya Obrabotko Metallov. No. 4; pp. 66 and 67; Apr. 1973.

Nitton Kinzoku Gakkai SHI, vol. 35, 1971, "Superplastic Phenomenon which is Obtained ... Within Ferrite Austenite Coexistence Region", pp. 1063–1066.

Weiss, V.; Metall 23, Dec. 1969, pp. 1264–1269.

Metal Abstracts; Jul.–Dec. 1972; Abstract No. 31–1846.

*Primary Examiner*—W. Stallard

*Attorney, Agent, or Firm*—Cushman, Darby & Cushman

[57] ABSTRACT

A method for providing a toughening treatment for metallic material in which the metallic material is subjected to a transformation super-plastic treatment by applying a mechanical load to said material while placing the same under a triangular-wave temperature cycle passing over a transformation point of the metallic material.

5 Claims, No Drawings

METHOD FOR TOUGHENING TREATMENT OF METALLIC MATERIAL

CROSS REFERENCE TO RELATED APPLICATIONS

This application is a continuation-in-part application of Ser. No. 537,393 filed Dec. 30, 1974, and now U.S. Pat. No. 4,045,254 which is relied upon and incorporated by reference herein.

BACKGROUND OF THE INVENTION

The present invention relates to a method for providing a toughening treatment for metallic material by making use of transformation super-plastic phenomena.

Heretofore, heat treatment of metallic materials has been conducted in various ways to enhance the mechanical strength and to improve toughness of metallic materials, including steel. However, most of the prior methods were heat treatments at elevated temperature extending over a long period of time because the aim was to disperse and separate non-metal interstitial substances such as carbides.

SUMMARY OF THE INVENTION

Therefore, it is an object of the present invention to provide a novel method for providing a toughening treatment for metallic materials that is based on a quite different principle from that in the prior art, and in which the treatment time is extremely short and wherein it is possible to widely reduce the cost of treatment compared with prior art methods.

The inventor of the present invention was conducting experimental research on transformation super-plasticity of soft steel, and during that period of time the inventor discovered that extreme micro-fining of crystal grains is observed in material which is subjected to said transformation super-plastic phenomena, and that said transformation super-plastic phenomena improves the mechanical properties of soft steel, as compared to those mechanical properties prior to the treatment. The present invention is based on that discovery.

One feature of the present invention is a method for providing a toughening treatment for metallic material, characterized in that the metallic material is subjected to a transformation super-plastic treatment by applying a mechanical load to said material while placing the same under a triangular-wave temperature cycle passing over a transformation point.

Above mentioned, as well as other, features and objects of this invention will become more apparent in the following detailed description with respect to preferred embodiments.

DETAILED DESCRIPTION OF THE PRESENTLY PREFERRED EMBODIMENTS

The essence of the present invention exists in the utilization of transformation super-plastic phenomena of metallic materials. In order to practice the method according to the present invention, heating means and cooling means for providing a triangular-wave temperature cycle as well as means for applying a mechanical load to the metallic materials are necessary. The heating means and cooling means are conventional apparatus in the pertaining art. For the heating means, for example, high frequency induction heating means or direct heating means (by passing a current through the material) are suitable. For the cooling means, for example, blowing means for pressurized air is suitable.

Any conventional means for applying a mechanical load which can fixedly secure one end of a body of metallic material and which can apply a shearing stress to the other end thereof, is adaptable for use in this method. For example, the base frame of the conventional turning lathe or any equivalent means could be used satisfactorily. The shearing stress could be selected approximately in the range of 1/10 - 1/20 of the yielding point (the durable stress) depending upon the kinds of the metallic materials.

According to the invention a shearing stress is applied to metallic material which subjecting the same to a triangular wave temperature cycle which should pass over the transformation point of the metallic material to effect a transformation super-plastic treatment. Then extreme micro-fining of crystal grains will occur, and simultaneously therewith equalization of a metallurgical structure will proceed. As a result, improvements in the properties of the material, as much as about 50% in strength and as much as about 20% in toughness, can be obtained. The effects of the treatment are not limited thereto. A correlative effect of improvement in anti-corrosion properties is obtained owing to micro-fining of the crystal grains.

With regard to treatment time, according to the present invention, it is shortened a great deal, compared to the prior art, so that a treatment time of only 30 seconds is sufficient; accordingly, production costs can be greatly reduced. Of course, the method according to this invention is applicable not only to steel, but also to other metals and alloys. Thus, it is effective for improvements in strength and toughness of various parts of machine structures.

The following description concerns one preferred embodiment in which experiments were conducted with soft steel. A test piece of soft steel (SS41) was mounted on a base frame of a turning lathe so that one end was fixedly secured and a shearing stress was applied by twisting the other end.

A shearing stress was applied to this test piece, while subjecting the test piece to a triangular-wave temperature cycle as specified in (a) or (b) below.

(a) In this case the heating and cooling cycle was based on the $Ac_1$ transformation point (a transformation point at 723° C.;) of the soft steel; the upper temperature limit of the heating cycle is set at 850° C., and the lower limit of the cooling cycle is set at 600° C.

(b) In this case the heating cycle was based on both the $Ac_1$ transformation point and the $Ac_3$ transformation point (a transformation point at 850° C.,); the upper temperature limit of the heating cycle is set at 950° C., and the lower limit of the cooling cycle is set at 600° C.

The period of one cycle was selected as at about 20 seconds, and heating and cooling were repeated for about three cycles while the shearing stress was selected to be equal to or lower than 3 kg/mm$^2$.

The strength and toughness prior to the treatment and after the treatment were compared and are set forth in the following Table:

| | Prior to Treatment | After Treatment |
|---|---|---|
| Upper Yielding Point (kg/mm$^2$) | 25.63 | 58.16 |
| Maximum Tensile Strength (kg/mm$^2$) | 43.08 | 70.71 |
| Elongation (%) | 24.18 | 25.12 |

-continued

| | Prior to Treatment | After Treatment |
|---|---|---|
| Contraction (%) | 56.20 | 69.40 |
| Intrinsic Breaking Stress (kg/mm$^2$) | 102.50 | 135.70 |

Above there has been shown a preferred embodiment in connection with a soft steel.

When a test piece of 18-8 stainless steel, with a transformation point (1100° C.,) was utilized, the test piece was subjected to three periods of temperature cycles (20 seconds/cycle) having an upper limit of 1150° C., and a lower limit of 1050° C., while variably selecting the shearing stress at 1, 2 and 3 kg/mm$^2$; experimental results as shown in the following Table 2 were obtained.

TABLE 2

| | Prior to Treatment | After Treatment | | |
|---|---|---|---|---|
| Applied Stress (kg/mm$^2$) | — | 1.0 | 2.0 | 3.0 |
| Tensile Strength (kg/mm$^2$) | 61.28 | 65.21 | 66.93 | 70.14 |
| Intrinsic Breaking Stress (kg/mm$^2$) | 173.41 | 184.34 | 183.31 | 193.83 |
| Elongation (%) | 64.5 | 66.5 | 65.0 | 64.5 |
| Contraction (%) | 73.83 | 77.40 | 75.45 | 75.60 |

In the above-described embodiments, the upper and lower limits of the temperature range in the temperature cycle were selected at ±120° C., with respect to the transformation point (soft steel) and at ±50° C., with respect to the transformation point (18-8 stainless steel), respectively, and the frequency of the temperature cycle was selected at 3 cycles/minute. These specific values were selected due to the variation of the transformation point caused by the change of the heating and cooling speeds as well as the time period required between the commencement and termination of the transformation which affects were taken into consideration. Upon practicing the present invention, the exact conditions for the temperature cycle passing through the transformation point, above and below the transformation point, so as to generate super-plastic phenomena such as, for example, a temperature range and a frequency, are selected according to the properties and shape of the material to be treated. The stress applied to the metallic material could be selected at about 1/10 to 1/20 of the yielding point (a maximum durable stress) of the metallic material.

With respect to other metals and alloys, innumerable embodiments of the invention could be practiced. For instance, duralumin may be used as the metallic material subjected to the method of the invention. Duralumin of the Al-Cu-Mg series containing Cu:Mg in a weight ratio of 7:1, on being subjected to the invention method, will separate a three-member compound, and will result in the formation of $Al_{18}Cu_7Mg_8$, within the duralumin, at the transformation point temperature. The presence of $Al_{18}Cu_7Mg_8$, and the degree to which it is dispersed throughout the alloy matrix, determine the toughness of the treated alloy. The effect of treatment in accordance with the invention may be evaluated be determining how uniformly and finely the $Al_{18}Cu_7Mg_8$ is dispersed. The temperature at which this phenomenon occurs varies with aluminum content of the duralumin. The result of employing duralumin in the method of the invention is improved toughness of the treated duralumin.

The toughening treatment for the above-described steels depends upon variation in the mode of arrangement of the crystal lattice of the matrix metal and secondarily upon the microfining of crystal grams in the steel. In the case of duralumin, toughing occurs not on account of large stresses which are used in the case of steel, but instead, the number of cycles required for separation of the intermetallic compounds ($Al_{1.8}Cu_7Mg_8$) is more important than for steel.

Table 3 represents comparative data concerning properties of samples of duralumin, prior to treatment in accordance with the method of the invention, and properties of those treated samples, respectively. The specific samples of Duralumin used in Table 3 have compositions which are described in Table (i)

TABLE (i)

| Elements / Samples | Cu | Si | Fe | Mn | Mg | Zn | Cr | Ti | Al |
|---|---|---|---|---|---|---|---|---|---|
| 2017 | 3.5–4.5 | <0.8 | <0.7 | 0.40–1.0 | 0.20–0.8 | <0.25 | <0.10 | — | remainder |
| 2024 | 3.8–4.8 | <0.5 | <0.5 | 0.30–0.9 | 1.2–1.8 | <0.25 | <0.10 | — | remainder |
| 2014 | 3.9–5.0 | 0.50 ~1.2 | <0.7 | 0.40–1.2 | 0.2–0.8 | <0.25 | <0.10 | <0.15 | remainder |

TABLE 3

| Duralumin Samples | Separating Temperatures | $T_{max}$ | $T_{min}$ | Applied Stress $\tau$ | No. of Cycles per minutes ∞ | Prior to Treatment: Tensile Strength | Prior to Treatment: Elongation | After Treatment* Tensile Strength | After Treatment* Elongation |
|---|---|---|---|---|---|---|---|---|---|
| 2017 | 320° C. | 400° C. | 250° C. | 0.8 kg/mm$^2$ | 5 times | 30 kg/mm$^2$ | 27% | 45 kg/mm$^2$ | 28% |
| 2024 | 450° C. | 500° C. | 400° C. | 1.0 kg/mm$^2$ | 5 times | 50 kg/mm$^2$ | 11% | 63 kg/mm$^2$ | 18% |
| 2014 | 465° C. | 500° C. | 400° C. | 1.0 kg/mm$^2$ | 5 times | 48 kg/mm$^2$ | 13% | 65 kg/mm$^2$ | 15% |

*Treatment: Toughening Treatment

Thus, if the method according to the present invention is applied to duralumin having a tensile strength of about 30 kg/mm$^2$, as above, then the material can be improved in tensile strength up to a super duralumin class having a tensile strength of about 40 kg/mm$^2$ or further up to an extra super duralumin class having a tensile strength of about 50 kg/mm$^2$. Furthermore, if the method according to the present invention should be applied to the latter two materials, then the super duralumin would be improved in quality up to the extra super duralumin, and the extra super duralumin would, in turn, be improved in quality up to a material having a still higher tensile strength.

In addition, if the method according to the present invention is applied to high tensile steel of the 50 kg/mm$^2$ class, then it will be improved in quality up to that of refined high tensile steel of 80 kg/mm$^2$ class and furthermore it will be still improved up to that of material of 100 kg/mm$^2$ class.

As will be obvious from the above description, the essence of the present invention exists in utilization of the phenomena of super-plasticity of metallic materials, and according to the present invention, the strength and toughness of the metallic material can be improved within an extremely short treatment time within which no conventional method can be completed. Therefore, the advantages which are given to the metallurgical industry by the present invention are remarkably great.

While I have described above the principles of my invention in connection with specific embodiments, it is to be clearly understood that this description is made only by way of example and not as a limitation to the scope of my invention as set forth in the accompanying claims.

What is claimed is:

1. A method for providing a toughening treatment for a piece of duralumin which has a transformation point, that is a limiting temperature at which a change in phase occurs, by making use of transformation super-plastic phenomena, consisting essentially of simultaneously (a) applying a shearing stress to the piece of duralumin, and (b) cyclicly heating for a half cycle and cooling for a half cycle the piece of duralumin, and in so doing, observing the following constraints:

(1) the applied shearing stress has a value in the range of about 1/20th to about 1/10th of the yield point of said duralumin;

(2) each half-cycle during which the duralumin is heated is raised to a temperature that is above the transformation point, and each half-cycle during which the duralumin is cooled, it is lowered to a temperature that is below said transformation point; and (3) the duralumin is subjected to at least three of these heating and cooling cycles.

2. The method of claim 1, wherein the temperature limits of the steps of cyclicly heating and cooling range from ±120° C., with respect to said transformation point.

3. The method of claim 1, wherein the temperature limits of cyclicly heating and cooling range from ±50° C., with respect to said transformation point.

4. The method of claim 1, wherein said duralumin has a tensile strength of 30 kg/mm$^2$ prior to steps (a) and (b) and has a tensile strength of about 40 kg/mm$^2$ after steps (a) and (b).

5. The method of claim 4, wherein said steps (a) and (b) are repeated by subjecting duralumin of a tensile strength of 40 kg/mm$^2$ to step (a) and then step (b) while observing said constraints.

* * * * *